United States Patent [19]

Beck

[11] 4,099,898

[45] Jul. 11, 1978

[54] ARRANGEMENT FOR AND METHOD OF INSERTING A NOZZLE UNIT INTO AN OPENING OF A SPINNING DEVICE

[75] Inventor: Arnold Beck, Würen, Fed. Rep. of Germany

[73] Assignee: Büttner-Schilde-Haas Aktiengesellschaft, Fed. Rep. of Germany

[21] Appl. No.: 779,939

[22] Filed: Mar. 21, 1977

[30] Foreign Application Priority Data

Mar. 20, 1976 [DE] Fed. Rep. of Germany ..... 2611940

[51] Int. Cl.[2] ..... B29C 1/16; D01D 3/00

[52] U.S. Cl. ..... 425/192 S; 425/382.2; 425/378 S; 29/428

[58] Field of Search ..... 425/190, 191 S, 192 S, 425/378 S, 379 S, 382.2; 264/176 F, 178 F; 29/200 P, 468, 526, 428

[56] References Cited

U.S. PATENT DOCUMENTS 3,830,617 8/1974 Coates et al. ..... 425/378 S X

FOREIGN PATENT DOCUMENTS 9,491 5/1967 Japan ..... 425/382.2

*Primary Examiner*—Robert L. Spicer, Jr.
*Attorney, Agent, or Firm*—Michael J. Striker

[57] ABSTRACT

An arrangement for inserting a nozzle unit in a spinning device for spinning synthetic fibers has shafts extending through and movable relative to the opening of the device, means for detachably connecting the first end portion of the shafts to the nozzle unit, and drive means connected to the second end portion of the shafts and operative for pulling the latter. When the nozzle unit is connected to the shafts, and the latter are pulled by the drive means, the nozzle unit enters the opening of the device. The shafts may move vertically or along a curved trajectory. The connecting means may be formed as hooks pivotally connected to the first end portions of the shafts by hinges and engageable with loops mounted on the nozzle unit. Hollow beams filled with a heat-carrying agent are built in a body part of the device. Means for actuating the drive means are located outside the hollow beam, and preferably, below the same.

15 Claims, 2 Drawing Figures

ARRANGEMENT FOR AND METHOD OF INSERTING A NOZZLE UNIT INTO AN OPENING OF A SPINNING DEVICE

BACKGROUND OF THE INVENTION

The present invention relates to an arrangement and a method of inserting nozzle units into an opening of a spinning device.

Spinning devices are used in a process of manufacturing polymeric articles, particularly, polymeric fibers. Polymeric material extruded from an extruder is admitted into the spinning device having a hollow beam filled with heat-carrying agent, and is further conveyed to nozzles located in an opening of the spinning device. The nozzles are connected to one another so as to form a nozzle unit. After a certain period of time the nozzle units must be replaced by new ones, for instance, for cleaning the nozzles clogged with the polymeric material.

Arrangements and methods for upwardly and downwardly inserting the nozzle units into the opening of the spinning device from above and from below, respectively, have already been proposed. In the case when the nozzle pack is inserted into the opening of the spinning device from above, an operator must perform the respective work both above and below the spinning device, that is in two planes. When the operator inserts the nozzle unit from above, he must not only observe the nozzle unit from above during the process of insertion, but also observe this from below for controlling correctness of positioning the nozzle unit and operational ability of the latter. This is very inconvenient time-consuming and labor-consuming operation. In addition, when the nozzle unit is inserted from above sealing of a conduit between the nozzle unit and the spinning beam takes place in a horizontal direction so that the nozzle pack is unilaterally compressed. In this case air gaps of various width exist between the hollow beam and the nozzle unit which diversely affect heat transmission from the beam to the nozzle pack.

When the nozzle pack is inserted from below, this has the disadvantage that the nozzle unit having an essentially great weight cannot be inserted manually, but only with use of additionally auxiliary equipment, such as for instance, hydraulic drive means. However, the hydraulic means does not assure rapidly and conveniently aligning with and fastening the nozzle units to the spinning device.

SUMMARY OF THE INVENTION

Accordingly, it is an object of the present invention to provide a novel arrangement and a novel method for inserting a nozzle unit into an opening of a spinning device wich avoids the disadvantages of the prior art arrangements and methods.

More particularly, it is an object of the present invention ro provide such an arrangement and a method for inserting a nozzle unit into an opening of a spinning device which assures more rapidly and conveniently inserting the nozzle unit with less labor-consuming and time-consuming operation that the conventional arrangements and methods permit.

In keeping with these objects, and with others which will become apparent hereinafter, one feature of the present invention resides in that the arrangement of the invention comprises at least one shaft extending through and movable relative to an opening of a spinning device and having two end portion, one of which end portions is detachably connected to a nozzle unit to be inserted, and the other end portion is connected to drive means operative for pulling the shaft connected to the nozzle unit so as to insert the latter into the opening of the spinning device. In accordance with the method of the invention, the shaft is positioned so that it extends through a portion of the spinning device and a first end portion extends outwardly through the opening of the latter; then the nozzle unit is detachably connected to the first end portion of the shaft, and the latter is pulled by engaging a second end portion of the shaft and moving it in a direction causing the first end portion and the nozzle unit connected to the same to enter the opening of the spinning device.

The thus performed insertion of the nozzle unit is less time-consuming and labor-consuming than the insertion of the nozzle unit by the conventional arrangements and methods. This is performed rapidly and conveniently, and does not require observation of the nozzle unit both from above, and from below.

Another feature of the present invention is that connecting means for connecting the shaft to the nozzle unit are formed as a hook pivotally connected to the first end portion of the shaft by a hinge, which hook engages the nozzle unit. The thus constructed connecting means assure rapid and convenient connection of the shaft with the nozzle unit prior to pulling the shaft for inserting the nozzle unit into the opening of the spinning device.

Still another feature of the present invention is that means for actuating drive means of the arrangement of the invention are located outside of the hollow beam and, more particularly, below the hollow beam. This permits especially convenient control operation of the arrangement of the invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
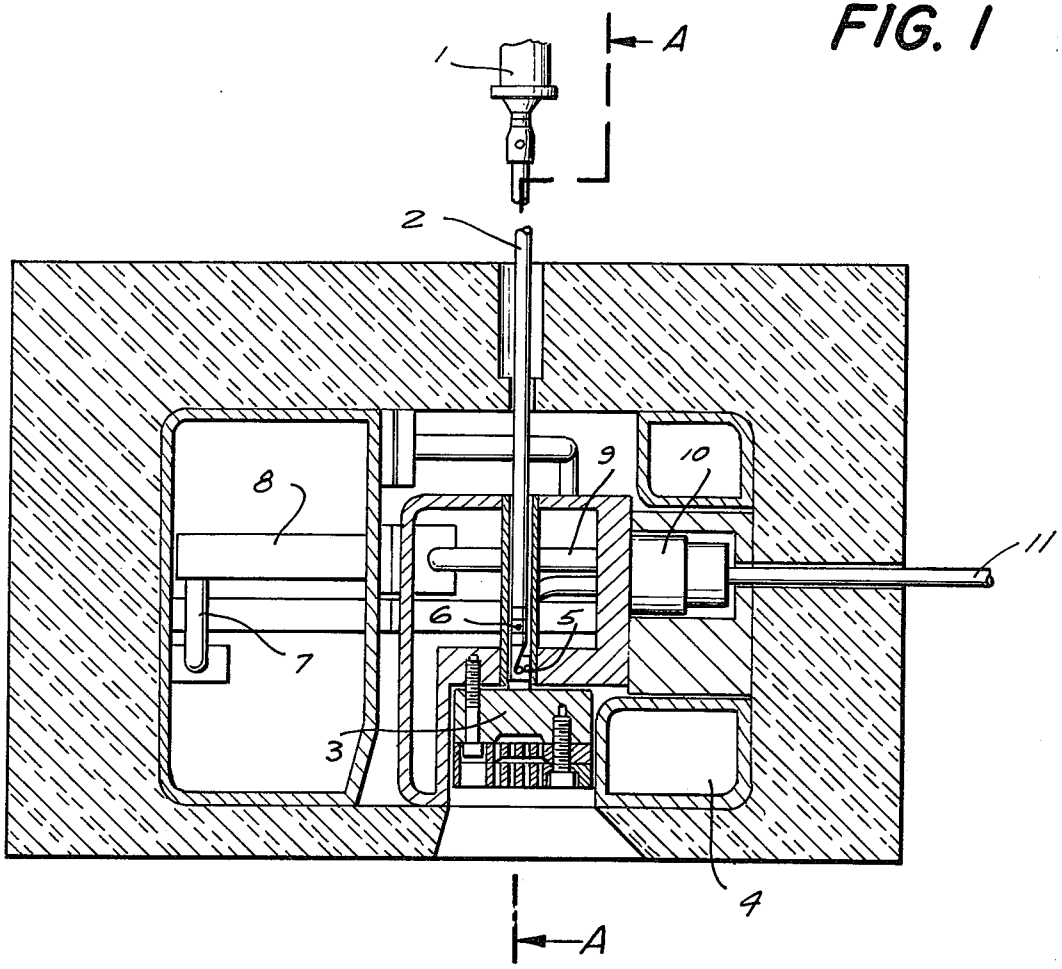
FIG. 1 is a sectional view of a spinning device provided with an arrangement for inserting a nozzle unit of the present invention.
Figure 2:
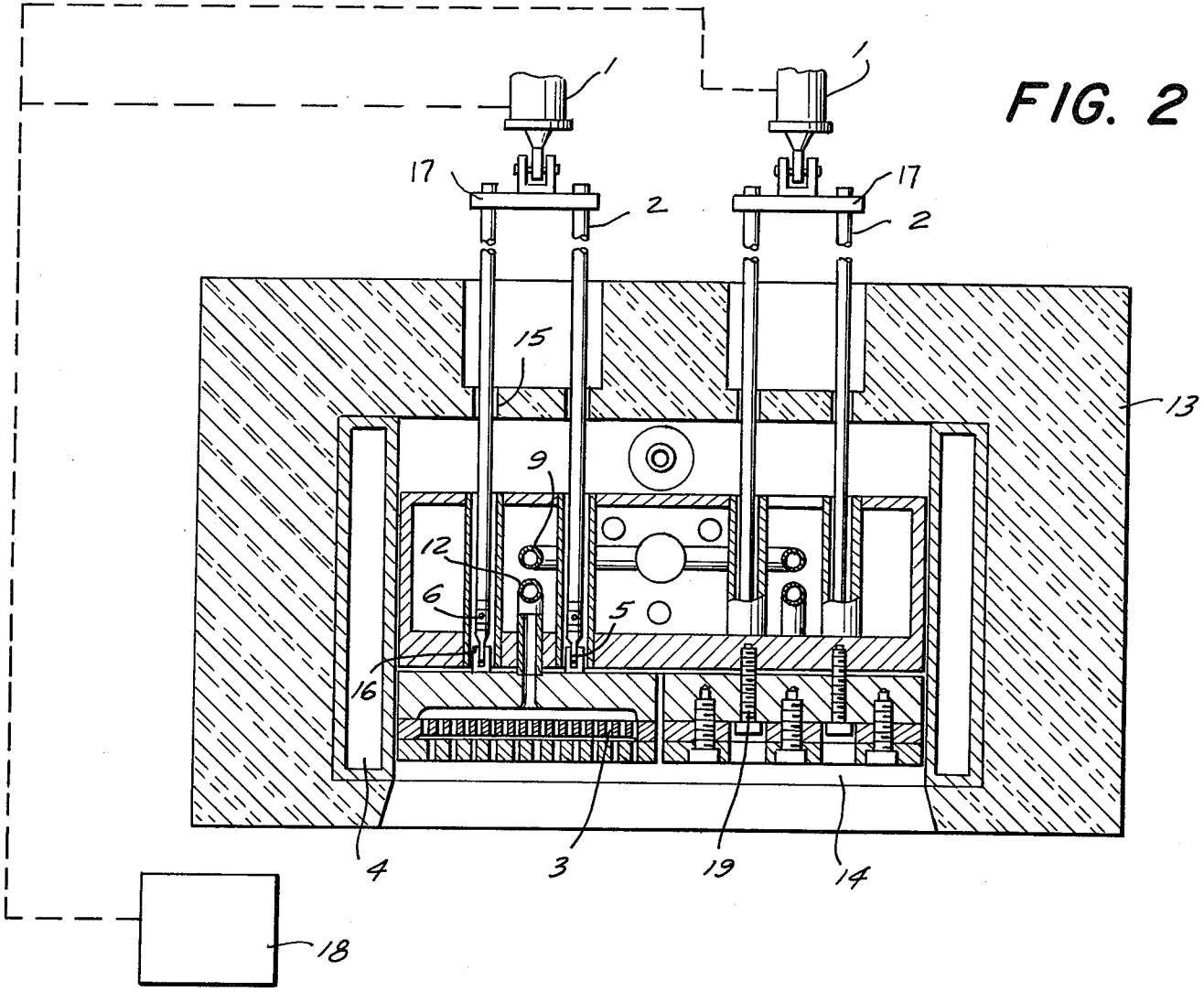
FIG. 2 is a cross section taken on line A — A of FIG. 1.

FIGS. 1 and 2 show a spinning device comprising a body part which is identified in toto by reference numeral 13 and has a central opening 14. Hollow beams 4 are located within the body part 13 and surround the opening 14. A known per se and not shown heat-carrying agent may be admitted into the hollow beams 4 so as to heat polymeric material in the device and to maintain the viscosity of the material at a level sufficient to assure its flowing through the respective parts of the device.

An input conduit 7 is connected with a filter 8 which latter is, in turn, connected by a conduit 9 with a pump 10. The pump 10 is driven by a shaft 11 outwardly projecting beyond the body part 13 of the spinning device. A conduit 12 leads from the pump 10 to a nozzle unit 3.

Shafts 2 are provided which extend through bores 15 communicating with the opening 14. The shafts 2 are movable relative to the opening 14 in a direction substantially coaxial with the axis of the same. As shown in FIG. 2, each two shafts 2 are parallel to one another, and their upper end portions are connected with one another by a cross-piece 17. The latter is connected to a driving element of drive means formed as a fluid-operated cylinder and piston unit, such as for instance, a pneumatic motor. The lower end portions of the shafts 2 are provided with means for detachably connecting the nozzle units 3 to the shafts 2. The connecting means are formed, for instance, as hooks 5 each pivotally connected to the lower end portion of the respective shaft 2 by a hinge 6. On the other hand, the nozzle units 3 are provided with engaging elements such as, for instance, loops 16 engageable with the hooks 5 mounted on the shafts 2.

While in the drawing the shafts 2 are shown connected in pairs with one another, and each pair of the shafts 2 is connected to the same drive means and to the same nozzle unit, it is understood that one shaft, three shafts or any desirable number thereof may be connected to the same drive means and to the same nozzle unit. Further, as shown in the drawing, the shafts 2 have rectilinear contour and they are movable in a vertical direction in the vertical through bores 15. However, the shafts 2 may have any other desirable contour and may move in a direction other than vertical one. In such case the shafts 2 may have a contour curved in the direction of its length. The shafts 2 may also be flexible so that they easily extend through the trough bore of any contour and can move along any curved trajectory.

Actuating means 18 are provided for actuating drive means 1, which actuating means are known per se, and therefore do not require any detailed comments. The actuating means 18 are located outside the hollow beams 4 and, preferably, below the same.

The device of the invention operates as follows:

Polymeric material is admitted into the input conduit 7 and thereafter passes through the filter 8 and the conduit 9 to the pump 10. By operation of the pump 10 the polymeric material is conveyed through the conduit 12 to the nozzle unit 3. When the nozzle unit 3 clogged with the polymeric material is removed, insertion of a new nozzle unit is performed in the following manner. The shafts 2 are introduced through the through bores 15 and then into the opening 14 so that the lower end portions of the shafts 2 extend outwardly through the latter. The nozzle unit 3 is connected to the lower end portions of the two shafts 2 by engaging the hooks 5 of the shafts 2 with the loops 16 of the nozzle unit 3. The respective drive means are actuated to upwardly pull the shafts 2 connected with the nozzle unit 3, and the latter enters the opening 14 of the spinning device. The nozzle unit 3 inserted into the opening 14 is connected to the respective part of the device by screw 19.

The shafts 2 may be retained in the through bores 15 of the spinning device so that they must not repeatedly be introduced into the device during insertion of each subsequent nozzle unit.

It will be understood that each of the elements described above, or two or more together, may also find a useful application in other types of constructions differing from the types described above.

While the invention has been illustrated and described as embodied in an arrangement for and method of inserting a nozzle unit into an opening of a spinning device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for inserting a nozzle unit into an opening of a spinning device, comprising at least one shaft extending through the opening of the spinning device and having a first end portion facing towards the nozzle unit to be inserted and a second end portion facing away thereof, said shaft being movable between a first position in which it is located in said opening and said first end portion thereof extends outwardly beyond the opening, and a second position in which said first end portion is retracted into the opening; means for detachably connecting said first end portion of said shaft to the nozzle unit when said shaft is located in said first position and said first portion, as well as the nozzle unit is located outside the opening of the spinning device; and drive means connected to said second end portion of said shaft and operative for displacing said shaft connected with the nozzle unit from said first position into said second position so that the nozzle unit is pulled by said shaft from outside the opening towards the latter and thereupon into said opening.

2. The arrangement as defined in claim 1; and further comprising at least one additional such shaft extending through the opening of the spinning device and having a further first end portion facing towards the nozzle unit, and a further second portion facing away thereof, said additional shaft being movable between a further first position in which it is located in said opening and said further first portion thereof extends outwardly beyond the opening, and a further second portion in which said further first end is retracted into the opening; and further comprising additional connecting means for detachably connecting said further end portion of said further shaft to the same nozzle unit to which said one shaft is connected when said further first end portion and the nozzle unit are located outside the opening; and said drive means being further connected to said further second portion of said additional shaft so as to simultaneously displace said one shaft and said additional shaft, whereby the nozzle unit is pulled by both said shafts from outside the opening towards the latter and thereupon into the openings.

3. The arrangement as defined in claim 1, wherein said device has a body part and a hollow beam located in said body part, said opening being formed in said body part of said spinning device.

4. The arrangement as defined in claim 3, wherein said body part has at least one through bore communicating with said opening, said one shaft being movable in said through bore.

5. The arrangement as defined in claim 4, wherein said through bore is substantially vertical and said shaft is movable in said through bore in a substantially vertical direction.

6. The arrangement as defined in claim 4, wherein said shaft is flexible.

7. The arrangement as defined in claim 6, wherein said shaft has a curved contour in the direction of its length.

8. The arrangement as defined in claim 1, particularly for inserting a nozzle unit into an opening having an axis, wherein said shaft is movable in a direction coaxial with said axis of said opening.

9. The arrangement as defined in claim 1, wherein said drive means are fluid-operated cylinder and piston unit.

10. The arrangement as defined in claim 1, wherein said connecting means are means for pivotally connecting said first end portion of said shaft to said nozzle unit.

11. The arrangement as defined in claim 6, wherein said connecting means include a hinge.

12. The arrangement as defined in claim 1, wherein said connecting means include at least one hook connected to said first portion of said shaft and engageable with said nozzle unit.

13. The arrangement as defined in claim 3; and further comprising means for actuating said drive means located outside of said hollow beam.

14. The arrangement as defined in claim 13, wherein said actuating means are located below said hollow beam.

15. The method of inserting a nozzle unit into an opening provided in a portion of a spinning device, comprising the steps of positioning at least one shaft so that it extends through the portion of the spinning device and a first end portion of the shaft extends outwardly beyond the opening thereof; detachably connecting the nozzle unit to the first portion of the shaft when the first portion of the shaft and the nozzle unit are located outside the opening of the spinning device; and displacing the shaft connected with the nozzle unit so that the latter is pulled by the shaft towards the opening of the spinning device and thereupon into the opening.

* * * * *